US005855236A

United States Patent [19]

Patton

[11] Patent Number: 5,855,236

[45] Date of Patent: Jan. 5, 1999

[54] BLIND ASSEMBLY

[76] Inventor: Mark A. Patton, 1933 Temple Ter., Clearwater, Fla. 34624

[21] Appl. No.: 934,712

[22] Filed: Sep. 22, 1997

[51] Int. Cl.[6] ..... E06B 9/26

[52] U.S. Cl. ..... 160/176.1 V; 160/900

[58] Field of Search ..... 160/168.1 V, 172 V, 160/173 V, 176.1 V, 178.1 V, 177 V, 900

[56] References Cited

U.S. PATENT DOCUMENTS

| | | | |
|---|---|---|---|
| 2,759,534 | 8/1956 | Harju | 160/168.1 V |
| 3,079,988 | 3/1963 | Green | 160/168.1 V |
| 4,657,061 | 4/1987 | Meier | 160/176 R |
| 5,291,946 | 3/1994 | Ciriaci | 160/177 |
| 5,407,008 | 4/1995 | Boloix | 160/177 |
| 5,577,542 | 11/1996 | Hung | 160/177 |

*Primary Examiner*—David M. Purol
*Attorney, Agent, or Firm*—Joseph N. Breaux

[57] ABSTRACT

A blind assembly that includes a pivoting support rail assembly, an opening and closing rod, at least two wall attachable rail supports, a number of vertical blind slats, and a blind slat spacing chain; the pivoting support rail assembly including a forward L-shaped slat support rail, a rear L-shaped slat support rail, and two hinge connectors, the forward and rear L-shaped support rails each including a slat engagement ridge extending outwardly from the shorter length leg thereof, each hinge connector being pivotally connected between the longer legs of the forward and rear L-shaped slat support rails and at the center thereof to one of the wall attachable rail supports in a manner such that the forward and rear L-shaped slat support rails move in opposite directions as the center of each hinge connectors pivots from the wall attachable rail supports; the opening and closing rod being secured to the forward L-shaped slat support rail; each wall attachable rail support including a wall attachment plate and a pivot plate including a hinge shaft receiving slot and a receiving slot closure.

16 Claims, 2 Drawing Sheets

BLIND ASSEMBLY

TECHNICAL FIELD

The present invention relates to screening systems and assemblies and more particularly to a blind assembly that includes a pivoting support rail assembly, an opening and closing rod, at least two wall attachable rail supports, a number of vertical blind slats, and a blind slat spacing chain; the pivoting support rail assembly including a forward L-shaped slat support rail, a rear L-shaped slat support rail, and two hinge connectors, the forward and rear L-shaped support rails each including a slat engagement ridge extending outwardly from the shorter length leg thereof, each hinge connector being pivotally connected between the longer legs of the forward and rear L-shaped slat support rails and at the center thereof to one of the wall attachable rail supports in a manner such that the forward and rear L-shaped slat support rails move in opposite directions as the center of each hinge connectors pivots from the wall attachable rail supports; the opening and closing rod being secured to the forward L-shaped slat support rail; each wall attachable rail support including a wall attachment plate and a pivot plate including a hinge shaft receiving slot and a receiving slot closure; each of the blind slats including a top end having a T-shaped connecting structure having a forward engagement slot, a rear engagement slot and a central spacing chain attachment slot, the forward engagement slot being positioned over the slat engagement ridge of the forward L-shaped slat support rail, the rear engagement slot being positioned over the slat engagement ridge of the rear L-shaped slat support rail; a link of the blind slat spacing chain being positioned into the central spacing chain attachment slot of each of the number blind slats.

BACKGROUND OF THE INVENTION

Vertical blind assemblies provide attractive and effective window and door screening within many buildings and homes. Although vertical blinds are popular, they often include an adjustment mechanism that is difficult to keep operational and blind slats that are difficult for the end user to replace. It would be a benefit, therefore, to have a blind assembly that included an adjustment mechanism having two rigid slat support rails between which the vertical blind slats are pivotally supported. In addition, it would of course also be a benefit to have a blind assembly that included a slat attachment mechanism that allowed a user to easily replace blind slats as they become worn or broken.

SUMMARY OF THE INVENTION

It is thus an object of the invention to provide a blind assembly.

It is a further object of the invention to provide a blind assembly that includes an adjustment mechanism having two rigid slat support rails between which the blind slats are pivotally supported.

It is a still further object of the invention to provide a blind assembly that includes a slat attachment mechanism that allows a user to easily replace blind slats as they become worn or broken.

It is a still further object of the invention to provide a blind assembly that includes a pivoting support rail assembly, an opening and closing rod, at least two wall attachable rail supports, a number of vertical blind slats, and a blind slat spacing chain; the pivoting support rail assembly including a forward L-shaped slat support rail, a rear L-shaped slat support rail, and two hinge connectors, the forward and rear L-shaped support rails each including a slat engagement ridge extending outwardly from the shorter length leg thereof, each hinge connector being pivotally connected between the longer legs of the forward and rear L-shaped slat support rails and at the center thereof to one of the wall attachable rail supports in a manner such that the forward and rear L-shaped slat support rails move in opposite directions as the center of each hinge connectors pivots from the wall attachable rail supports; the opening and closing rod being secured to the forward L-shaped slat support rail; each wall attachable rail support including a wall attachment plate and a pivot plate including a hinge shaft receiving slot and a receiving slot closure; each of the blind slats including a top end having a T-shaped connecting structure having a forward engagement slot, a rear engagement slot and a central spacing chain attachment slot, the forward engagement slot being positioned over the slat engagement ridge of the forward L-shaped slat support rail, the rear engagement slot being positioned over the slat engagement ridge of the rear L-shaped slat support rail; a link of the blind slat spacing chain being positioned into the central spacing chain attachment slot of each of the number blind slats.

It is a still further object of the invention to provide a blind assembly that accomplishes some or all of the above objects in combination.

Accordingly, a blind assembly is provided. The blind assembly includes a pivoting support rail assembly, an opening and closing rod, at least two wall attachable rail supports, a number of vertical blind slats, and a blind slat spacing chain; the pivoting support rail assembly including a forward L-shaped slat support rail, a rear L-shaped slat support rail, and two hinge connectors, the forward and rear L-shaped support rails each including a slat engagement ridge extending outwardly from the shorter length leg thereof, each hinge connector being pivotally connected between the longer legs of the forward and rear L-shaped slat support rails and at the center thereof to one of the wall attachable rail supports in a manner such that the forward and rear L-shaped slat support rails move in opposite directions as the center of each hinge connectors pivots from the wall attachable rail supports; the opening and closing rod being secured to the forward L-shaped slat support rail; each wall attachable rail support including a wall attachment plate and a pivot plate including a hinge shaft receiving slot and a receiving slot closure; each of the blind slats including a top end having a T-shaped connecting structure having a forward engagement slot, a rear engagement slot and a central spacing chain attachment slot, the forward engagement slot being positioned over the slat engagement ridge of the forward L-shaped slat support rail, the rear engagement slot being positioned over the slat engagement ridge of the rear L-shaped slat support rail; a link of the blind slat spacing chain being positioned into the central spacing chain attachment slot of each of the number blind slats.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
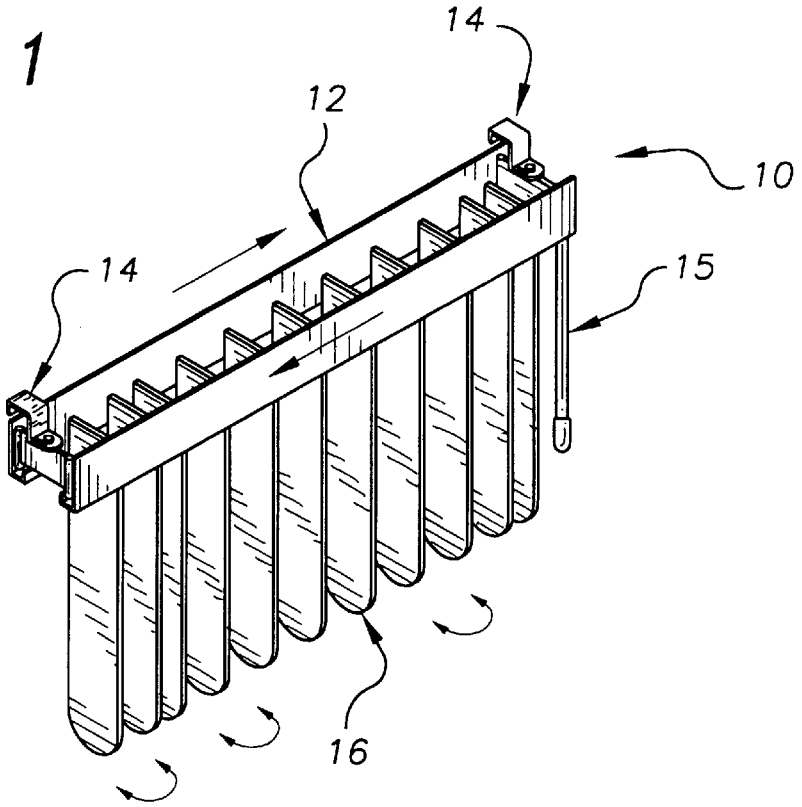
FIG. 1 is a perspective view of an exemplary embodiment of the blind assembly of the present invention showing the pivoting support rail assembly, the opening and closing rod, the wall attachable rail supports, and a number of vertical blind slats.

FIG. 1 shows an exemplary embodiment of the blind assembly of the present invention generally designated by the numeral 10.

Figure 3:
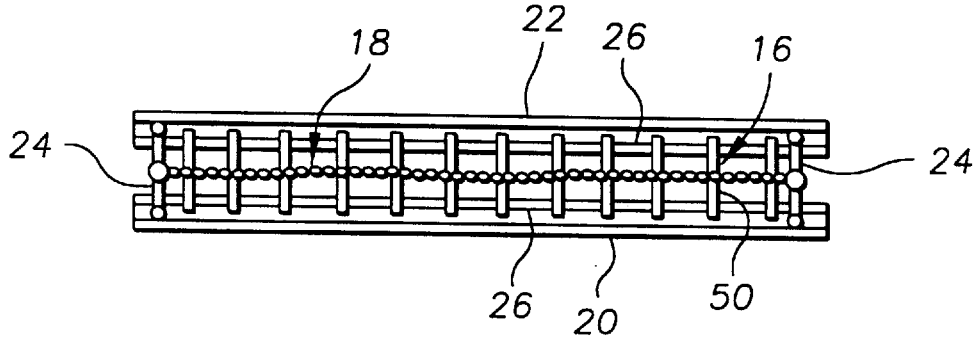
FIG. 3 is a top plan view of the blind assembly of FIG. 1 with the wall attachable rail supports removed showing the vertical blind slats supported between the forward and rear L-shaped slat support rails and spaced by the slat spacing chain.
Figure 4:
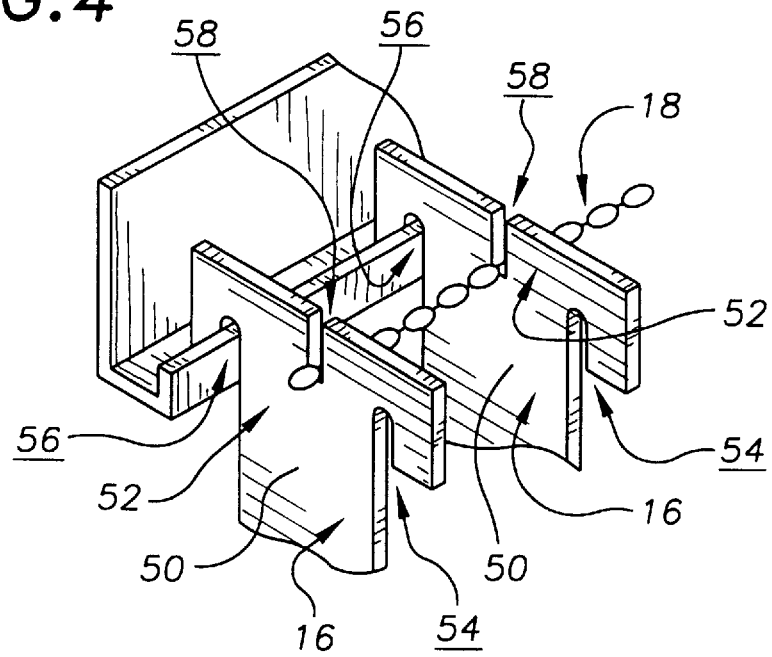
FIG. 4 is a detail perspective view showing the top ends of two of the blind slats each including a T-shaped connecting structure and a central spacing chain attachment slot.

In this embodiment, blind assembly 10 includes a pivoting support rail assembly, generally designated 12; an opening and closing rod, generally designated 15; two wall attachable rail supports, generally designated 14; a number of vertical blind slats, generally designated 16; and a blind slat spacing chain, generally designated 18 (FIGS. 3,4).

Figure 2:
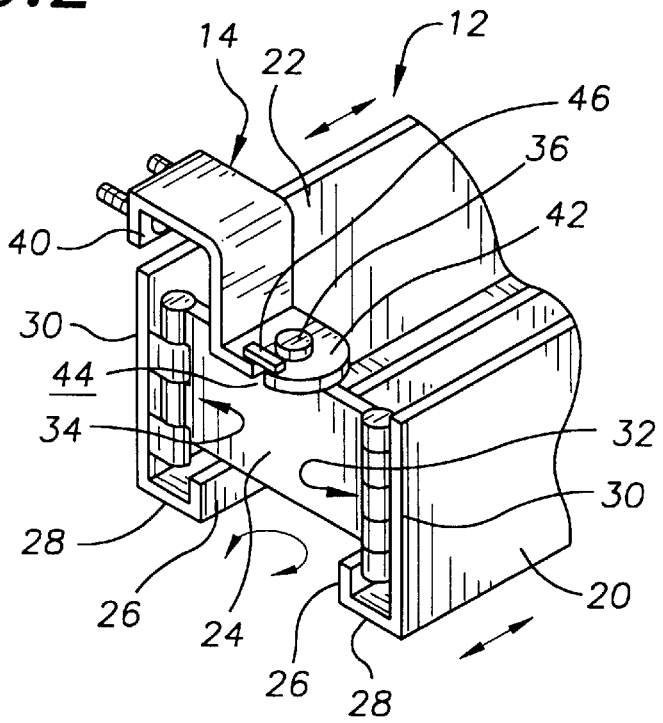
FIG. 2 is a detail perspective view of one of the hinge connectors of the pivoting support rail assembly pivotally connected at the ends thereof between the forward and rear L-shaped slat support rails and at the center thereof to one of the wall attachable rail supports.

With reference to FIG. 2, pivoting support rail assembly 12 includes a forward L-shaped slat support rail 20, a rear L-shaped slat support rail 22, and two identical hinge connectors 24 (both shown in FIG. 3. Forward and rear L-shaped support rails 20,22 are each of extruded plastic construction and each includes a slat engagement ridge 26 that extends outwardly at a right angle from a shorter length leg 28 of each support rail 20,22. Each hinge connector 24 in this embodiment is of rigid plastic construction and is pivotally connected between the longer legs 30 of L-shaped slat support rails 20,22 by hinge connections 32,34; and pivotally connected to a wall attachable support rail 14 by a hinge pin shaft 36 that extends from the center of hinge connector 24.

Each wall attachable rail assembly 14 is of stamped metal construction and includes a wall attachment plate 40 having a pair of screw apertures for mounting wall attachment plate 40 to a wall and a pivot plate 42 having a hinge pin shaft receiving slot 44 that is sized to receive hinge pin shaft 36 thereinto and a slot closure 46 that is positionable across hinge pin shaft receiving slot 44 to retain hinge pin shaft 36 therewithin. With hinge pin shaft 36 pivotally trapped within hinge pin shaft receiving slot 44 forward and rear L-shaped slat support rails 20,22 are constrained to move in opposite directions as each hinge connector 24 pivots at each hinge pin shaft 36 from a wall attachable rail support 14.

With reference to FIG. 3, each vertical blind slat 16 has a top end 50 that is moveably secured between the slat engagement ridges 26 of forward and rear L-shaped support rails 20,22. Spacing of vertical blind slats 16 is maintained by blind slat spacing chain 18.

With reference to FIG. 4, each top end 50 of each vertical blind slat 16 has a T-shaped connecting structure 52 having a forward engagement slot 54, a rear engagement slot 56 and a central spacing chain attachment slot 58. During assembly, forward engagement slot 54 and rear engagement slot 56 are positioned over slat engagement ridges 26 of forward and rear L-shaped support rails 20,22, respectively (FIG. 3).

With general reference to FIGS. 1–4, operation of blind assembly 10 is simple, to open or close blind assembly 10, opening and closing rod 15 is grasped and forward L-shaped support rail 20 is positioned to the left or right causing vertical blind slats 16 to be configured into an open or a closed position. Should a blind slat 16 become damaged, it can be easily removed by disengaging spacing chain 18 from central spacing chain attachment slot 58 and the lifting the blind slat 16 sufficiently to lift forward engagement slot 54 and rear engagement slot 56 from slat engagement ridges 26 of forward and rear L-shaped support rails 20,22. Replacement of a vertical blind slat 16 is accomplished by reversing the previous steps.

It can be seen from the preceding description that a blind assembly has been provided that includes an adjustment mechanism having two rigid slat support rails between which the blind slats are pivotally supported; that includes a slat attachment mechanism that allows a user to easily replace blind slats as they become worn or broken; and that includes a pivoting support rail assembly, an opening and closing rod, at least two wall attachable rail supports, a number of vertical blind slats, and a blind slat spacing chain; the pivoting support rail assembly including a forward L-shaped slat support rail, a rear L-shaped slat support rail, and two hinge connectors, the forward and rear L-shaped support rails each including a slat engagement ridge extending outwardly from the shorter length leg thereof, each hinge connector being pivotally connected between the longer legs of the forward and rear L-shaped slat support rails and at the center thereof to one of the wall attachable rail supports in a manner such that the forward and rear L-shaped slat support rails move in opposite directions as the center of each hinge connectors pivots from the wall attachable rail supports; the opening and closing rod being secured to the forward L-shaped slat support rail; each wall attachable rail support including a wall attachment plate and a pivot plate including a hinge shaft receiving slot and a receiving slot closure; each of the blind slats including a top end having a T-shaped connecting structure having a forward engagement slot, a rear engagement slot and a central spacing chain attachment slot, the forward engagement slot being positioned over the slat engagement ridge of the forward L-shaped slat support rail, the rear engagement slot being positioned over the slat engagement ridge of the rear L-shaped slat support rail; a link of the blind slat spacing chain being positioned into the central spacing chain attachment slot of each of the number blind slats.

It is noted that the embodiment of the blind assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A blind assembly comprising:

a pivoting support rail assembly;

at least two wall attachable rail supports;

a number of vertical blind slats; and a blind slat spacing chain;

said pivoting support rail assembly including a forward L-shaped slat support rail, a rear L-shaped slat support rail, and two hinge connectors, said forward and rear L-shaped support rails each including a slat engagement ridge extending outwardly from a shorter length leg thereof, each hinge connector being pivotally connected between the longer legs of said forward and rear L-shaped slat support rails and at a center thereof to one of said wall attachable rail supports in a manner such that said forward and rear L-shaped slat support rails move in opposite directions as each said center of each hinge connectors pivots from a said wall attachable rail support;

each wall attachable rail support including a wall attachment plate and a pivot plate including a hinge pin shaft receiving slot and a receiving slot closure;

each of said number of vertical blind slats including a top end having a T-shaped connecting structure having a forward engagement slot, a rear engagement slot and a central spacing chain attachment slot, said forward engagement slot being positioned over said slat engagement ridge of said forward L-shaped slat support rail, said rear engagement slot being positioned over said slat engagement ridge of said rear L-shaped slat support rail;

a link of said blind slat spacing chain being positioned into said central spacing chain attachment slot of each of said number blind slats.

2. The blind assembly of claim 1, further including:

an opening and closing rod that is secured to said forward L-shaped slat support rail.

3. The blind assembly of claim 1, wherein:

each of said number of vertical blind slats is cut from a sheet material.

4. The blind assembly of claim 1 wherein:

said forward and said rear L-shaped slat support rails are extruded plastic member.

5. The blind assembly of claim 1 wherein:

each said hinge connector includes a hinge pin shaft extending from said center thereof, said hinge pin shaft being sized to fit into said hinge shaft receiving slot of said wall attachable rail support.

6. The blind assembly of claim 2, wherein:

each of said number of vertical blind slats is cut from a sheet material.

7. The blind assembly of claim 2 wherein:

said forward and said rear L-shaped slat support rails are extruded plastic member.

8. The blind assembly of claim 2 wherein:

each said hinge connector includes a hinge pin shaft extending from said center thereof, said hinge pin shaft being sized to fit into said hinge shaft receiving slot of said wall attachable rail support.

9. The blind assembly of claim 6 wherein:

said forward and said rear L-shaped slat support rails are extruded plastic member.

10. The blind assembly of claim 6 wherein:

each said hinge connector includes a hinge pin shaft extending from said center thereof, said hinge pin shaft being sized to fit into said hinge shaft receiving slot of said wall attachable rail support.

11. The blind assembly of claim 9 wherein:

each said hinge connector includes a hinge pin shaft extending from said center thereof, said hinge pin shaft being sized to fit into said hinge shaft receiving slot of said wall attachable rail support.

12. The blind assembly of claim 7 wherein:

each said hinge connector includes a hinge pin shaft extending from said center thereof, said hinge pin shaft being sized to fit into said hinge shaft receiving slot of said wall attachable rail support.

13. The blind assembly of claim 3 wherein:

said forward and said rear L-shaped slat support rails are extruded plastic member.

14. The blind assembly of claim 3 wherein:

each said hinge connector includes a hinge pin shaft extending from said center thereof, said hinge pin shaft being sized to fit into said hinge shaft receiving slot of said wall attachable rail support.

15. The blind assembly of claim 13 wherein:

each said hinge connector includes a hinge pin shaft extending from said center thereof, said hinge pin shaft being sized to fit into said hinge shaft receiving slot of said wall attachable rail support.

16. The blind assembly of claim 4 wherein:

each said hinge connector includes a hinge pin shaft extending from said center thereof, said hinge pin shaft being sized to fit into said hinge shaft receiving slot of said wall attachable rail support.

* * * * *